US005826274A

United States Patent [19]

Thompson

[11] Patent Number: 5,826,274

[45] Date of Patent: Oct. 27, 1998

[54] METHOD AND APPARATUS FOR FACILITATING THE APPLICATION AND REMOVAL OF A WET SUIT

[76] Inventor: Michael Thompson, 16460 Hwy. 3, #906, Webster, Tex. 77598

[21] Appl. No.: 890,297

[22] Filed: Jul. 9, 1997

Related U.S. Application Data

[63] Continuation-in-part of Ser. No. 685,824, Jul. 25, 1996, abandoned.

[51] Int. Cl.[6] ..... A41D 13/00

[52] U.S. Cl. ..... 2/69; 2/2.15; 2/272

[58] Field of Search ..... 2/2.15, 2.16, 456, 2/2.17, 69, 272, 82, 101, 67, 80, 83, 111

[56] References Cited

U.S. PATENT DOCUMENTS

| | | |
|---|---|---|
| 2,749,551 | 6/1956 | Garbellano . |
| 2,981,954 | 5/1961 | Gabellano . |
| 3,744,054 | 7/1973 | Schultz . |
| 3,763,498 | 10/1973 | Rector . |
| 4,067,064 | 1/1978 | Cerniway et al. . |
| 4,408,357 | 10/1983 | Toth . |
| 4,438,531 | 3/1984 | Long et al. . |
| 4,483,019 | 11/1984 | Spangrud et al. . |
| 4,710,978 | 12/1987 | Pankopf . |
| 4,853,977 | 8/1989 | Foreman . |
| 4,907,295 | 3/1990 | Yasuda . |
| 4,999,845 | 3/1991 | Jenks et al. . |
| 5,005,216 | 4/1991 | Blackburn et al. . |
| 5,274,852 | 1/1994 | Hogan . |
| 5,603,116 | 2/1997 | Trone . |
| 5,631,074 | 5/1997 | Herlihy . |

*Primary Examiner*—C. D. Crowder
*Assistant Examiner*—Shirra L. Jenkins
*Attorney, Agent, or Firm*—Harrison & Egbert

[57] ABSTRACT

A method and article for facilitating the application of a wet suit to a human body having a torso portion with a first arm member and a second arm member extend outwardly from opposite sides of the torso portion. The first and second leg members extend downwardly from the torso portion. The torso portion, the leg members and the arm members are formed of a spun high density polyethylene fiber material. First and second mittens are also formed of the same material and are removably affixed adjacent to the first and second arm members, respectively. First and second boots are also formed of the same material and are removably affixed adjacent to the first and second leg members, respectively. The torso portion has a V-shaped open area formed on a back surface of the torso portion.

8 Claims, 4 Drawing Sheets

FIG. 3
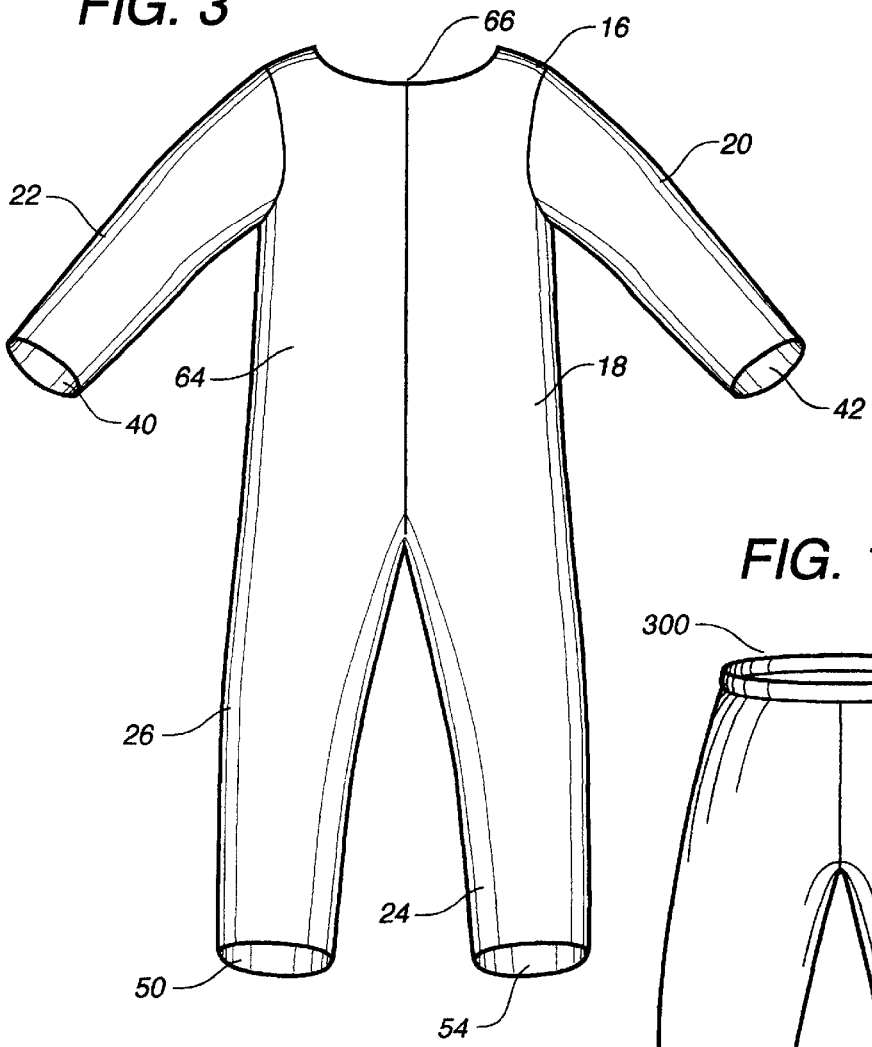
FIG. 10
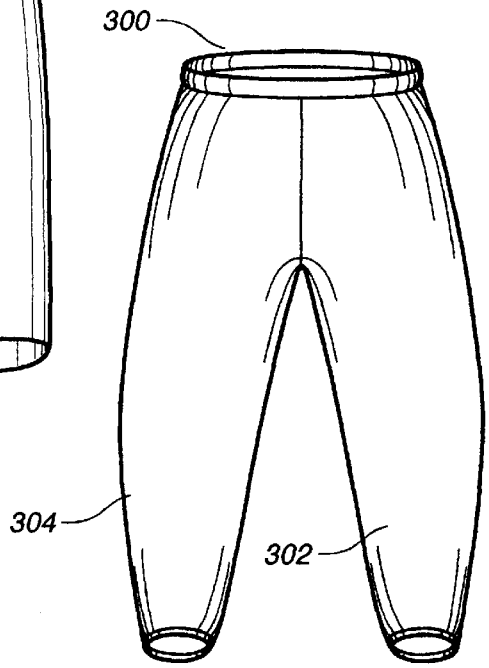
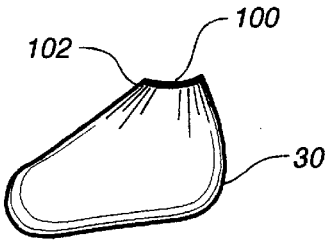
FIG. 6
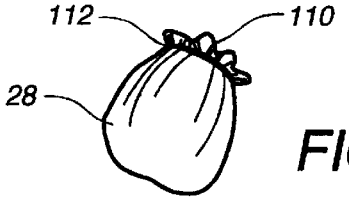
FIG. 7

METHOD AND APPARATUS FOR FACILITATING THE APPLICATION AND REMOVAL OF A WET SUIT

The present application is a continuation-in-part of U.S. patent application Ser. No. 08/685,824, filed on Jul. 25, 1996, and entitled "ARTICLE FOR FACILITATING THE APPLICATION AND REMOVAL OF A WET SUIT", now abandoned.

TECHNICAL FIELD

The present invention relates to wet suits. More particularly, the present invention relates to articles that facilitate the application and removal of the wet suit.

BACKGROUND ART

Cellular rubber, especially NEOPRENE (TM), has long been used as a body protection material. It is commonly used for wet suit where its insulating ability inhibits heat loss from a human body to surrounding cooler water. Wet suits are not intended to be waterproof but rather allow a thin layer of water to exist between the cellular rubber and the body surface, the thin layer of water being warmed by the human body. While these conventional cellular rubber body protection materials function effectively as thermal insulation, they are notoriously uncomfortable if worn for any length of time. Wet suits are difficult to put on and remove because of the high friction, adhesive qualities of the cellular rubber against the skin that resists fitting the garment into place. This same characteristic resists any movement between the cellular rubber and adjacent skin and results in discomfort during body movement. The presence of a thin layer of water between the cellular rubber and the skin does little to improve the lack of movement between the cellular rubber and adjacent skin. Further, perspiration is trapped between the cellular rubber and the skin, causing a sticky, clammy and itchy sensation that adds to the feeling of discomfort. Cellular rubber is also known to irritate the skin of many wearers and causes allergenic reactions in some cases.

In the past, various patents have issued on various devices relating to the application and use of wet suits. For example, U.S. Pat. No. 2,981,954, issued on May 2, 1961 to D. W. Garbellano is the original patent for the wet suit. In particular, this patent describes the formation of the wet suit, the material used for the wet suit, and the technique for forming the wet suit.

U.S. Pat. No. 3,660,849, issued on May 9, 1972, to Jonnes et al. describes a deep submergence diving suit which maintains low thermal conductivity at great depths and provides constant buoyancy at changing depths. This suit has a layer of thixotropic material, such as a grease, or a very low modulus elastomeric material filled with hollow glass microbubbles as an insulating layer. The diving suit is intended to provide warmth to the human body in deep sea diving, but has limited facilitated application use since lubricants have been found to be minimally effective for suit application, create pollution, and can even be harmful to the user.

U.S. Pat. No. 4,274,158, issued on Jun. 23, 1981, to Pogorski et al. describes an insulating material suitable for use in a diver's garment. The insulating material includes a multiplicity of layers of a flexible, stretchable material. These layers include a central core consisting of a gas permeable layer of material that is substantially non-compressible when at least partially evacuated and subject to hydrostatic pressure when immersed in water. Two further gas impermeable layers are provided, each being of a stretchable material with the central core being disposed intermediate to the layers. When formed into a diver's garment, the peripheral edges of the insulating material are sealed. While this design may create an insulating layer for the user, it does nothing to expedite the application of the suit.

U.S. Pat. No. 4,438,531, issued on Mar. 27, 1984, to Long et al. describes a low friction means for facilitating the application of an underwater diving suit. This underwater diving suit construction provides skirts of low friction material adjacent the openings through which the diver inserts his hand, hands and feet. This greatly facilitates getting into the suit and reduces the discomfort which normally accompanies this action. The suit can be installed without requiring special aid, such as greases or powders and greatly increases the life and dependability of the seals which are used on the diving suit. This invention may facilitate the application of the garment, but provides no additional insulation to the wearer. Furthermore, the skirts become a permanent attachment to the suit.

U.S. Pat. No. 4,494,246, issued on Jan. 22, 1985, to A. A. C. Tillbrook describes a protective article of clothing for protecting the wearer from cold during aquatic sports. This article of clothing is a one piece garment in which the leg portions and a body portion are formed of expanded rubber. The arm portions are formed of a loose waterproof material giving freedom of movement for the arms but providing less thermal insulation.

U.S. Pat. No. 4,959,059, issued on Sept. 25, 1990, to Eilender et al. teaches a low friction multi-layer pad which is in the form a diaper with panels fittable to the person's body. The pad has a first slippery non-porous layer on which is a moisture absorbent second layer. A slippery, thin, porous third layer is on the second layer. The three layers are peripherally bonded to form a non-penable seam which permits unbonded areas of the layers to slide slightly. The third layer may be sprayed with a filmy, dry, slippery fourth layer. A fifth layer of lubricating material, either a microencapsulated lubricant or a free lubricant, is applied to the third and fourth layers to form a very slippery top surface. This invention employs the use of potentially polluting lubricants that can cause skin reactions to the wearer and interfere with the original integrity of the wet suit.

U.S. Pat. No. 5,397,628, issued on Mar. 14, 1995, to Crawley et al. describes a laminated, air impermeable cellular rubber body protection material with porous expanded polytetrafluoroethylene material. This wet suit is formed of cellular rubber with an inner layer of the porous polytetrafluoroethylene material. It is useful as a wet suit so as to provide improved wearing comfort and for reducing allergenic reactions in comparison with conventional cellular rubber body protection materials. However, the liner is not detachable from the main suit.

British Patent No. 1,313,790, published on Apr. 18, 1973 , to A. Hollinshead describes an improved wet suit which has a lining of a knitted textile fabric which is intimately bonded to the inner layer of the wet suit. In particular, the inner surface of the wet suit is coated with a suitable adhesive and then a flock material is applied to the adhesive. This invention does not address the issue of the adhesive qualities when applying or removing the suit.

U.S. Pat. No. 5,603,116, issued on Feb. 18, 1997, to Tronc describes a tight fitting garment which interacts with a perforated film of a slippery non-porous material which is applied and or adjoined onto at least part of the internal surface of a wet suit or other aquatic sportswear or in a second embodiment, fit as an undergarment and worn separately. This film is made of plastic, or more specifically, a low density polyethylene or any non-porous material enabling the skin to slide against it. The non-porous material should be comprised of a plurality of holes or gaps allowing for perspiration, with said holes being distributed quincunxially and having a diameter or size of the order of a few millimeters. These holes serve the additional purpose of securing the wearer within the suit, a safety measure Tronc claims as necessary to secure the user within the garment so it does not slide or create discomfort to the user. The tight fitting garments Tronc describes are in the form of trousers, shorts, jackets, vests, gloves, and socks. Although low density polyethylene materials have slippery qualities, the integrity of the material itself is not conducive to maintaining its structural intensity, especially when worn independently, therefore this method is not cost efficient in terms of reusable qualities. Non-porous materials such as a low density polyethylene are not anti-static materials, and even with perforations, non-porous low density plastics can eventually create reactions to the skin.

It is another object of the present invention to provide a loose fitting garment such as that when worn as an undergarment with aquatic sports wear such as a wet suit, will provide additional insulation to the user by allowing the body to heat the layer of water trapped between the garment and the wet suit.

It is an additional object of the invention to provide a comfortable hygienic garment made of a porous high density plastic which not obstruct the breatheability of the skin.

It is a further object of the invention to provide a reusable garment for wearing when applying already damp or wet aquatic sports wear that will not only facilitate the application of the sports wear, but make the application of a cold or uncomfortable wet suit much more tolerable by insulating the immediate skin surface area from the cold cellular rubber.

It is still a further object of the invention to provide an article for wearing as an undergarment beneath a wetsuit or other related aquatic sports wear which, as an independent garment maintains its structural integrity, even after several applications, and is easy to manufacture, easy to use and relatively inexpensive to the user.

It is an object of the present invention to provide an article that facilitates the application and removal of a wet suit or other related aquatic sports wear without disturbing the integral comfort of the user.

These and other objects and advantages of the present invention will become apparent from a reading of the attached specification and appended claims.

SUMMARY OF THE INVENTION

The present invention is an article for facilitating the application of a wet suit to a human body. This article includes a torso portion having a first arm member extending outwardly from one side of the torso portion and a second arm member extending outwardly from an opposite side of the torso portion. First and second leg members extend downwardly from the bottom of the torso portion. The arm members, the leg members and the torso portion are all made of a spun high density polyethylene fiber material. The torso portion has a V-shaped open area formed therein. The V-shaped open area is wider at the top of the torso portion and narrower at the bottom of the torso portion.

In the article of the present invention, first and second thumbless mittens are formed of the same material. These mittens are removably positioned adjacent to the ends of the arm members opposite the torso portion. First and second boot members are also formed of the spun high density polyethylene fiber material. These boot members are removably positioned adjacent to the ends of the leg members' opposite the torso portion. Additionally, footless socks are also formed of the spun high density polyethylene fiber material. These footless sock are removably affixed adjacent to the ends of the leg members opposite the torso portion.

The present invention is also a method for facilitating the application of a wet suit. This method includes the steps of: (1) forming a coverall suit of a spun high density polyethylene fiber material; (2) placing the coverall suit onto the human body such that arms extend through arm members of the coverall suit and lets extend through leg members of the coverall suit; (3) sliding legs of the wet suit over the leg members of the coverall suit such that human feet extend outwardly of the legs of the wet suit; (4) sliding arms of the wet suit over the arm members of the coverall suit such that human hands extend outwardly of the ends of the arms of the wet suit; and (5) closing the wet suit over the torso portion of the coverall suit.

BRIEF DESCRIPTION OF THE DRAWINGS

FIG. 3 is a frontal view of the article of the present invention.

FIG. 6 is an isolated view of the boot of the present invention.

FIG. 7 is an isolated view of the thumbless mitten of the present invention.

FIG. 10 is a frontal view of an alternative embodiment of the article of the present invention.

DETAILED DESCRIPTION OF THE INVENTION

Figure 1:
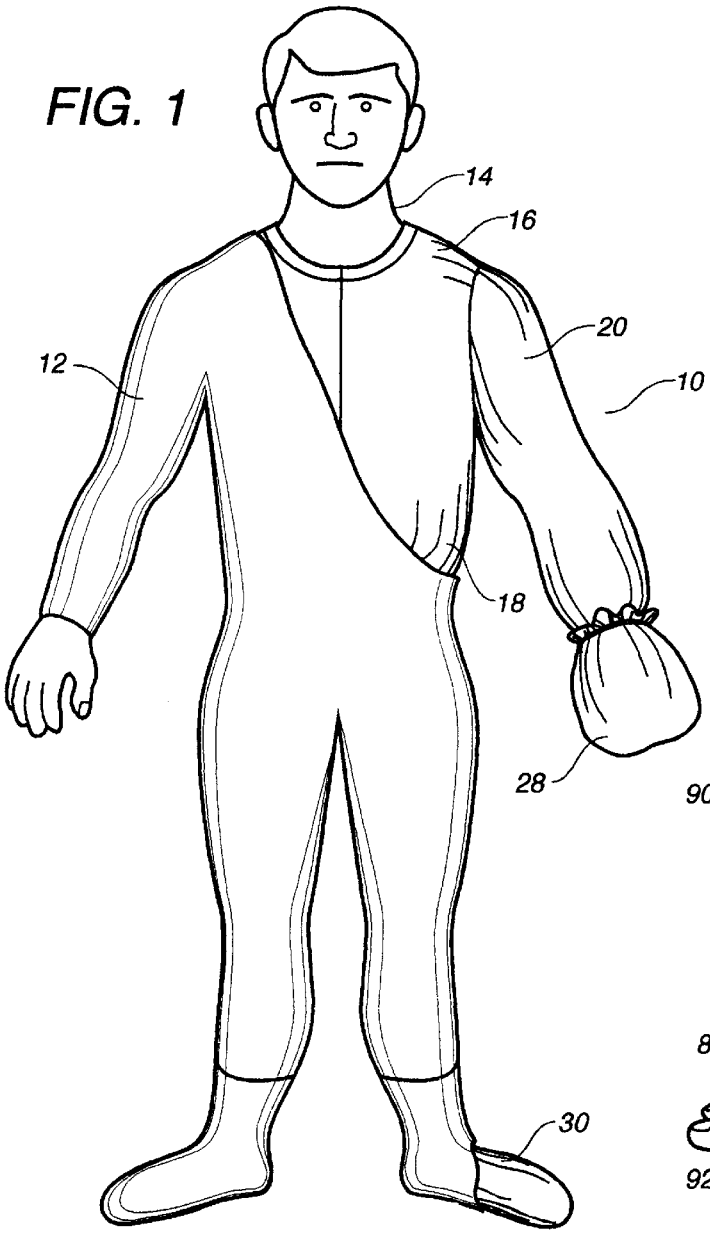
FIG. 1 is a frontal view showing the article of the present invention as applied onto the human body and with a wet suit covering the article.

Referring to FIG. 1, there is shown at 10 the article for facilitating the application of a wet suit 12 onto a human body 14. The article 10 is a coverall suit that extends over the arms, legs and torso of the human body 14 in a loose fitting fashion (at least ⅙ greater than the size or volume of the human body 14). The coverall suit is not skin-tight.

It can be seen in FIG. 1 that the coverall suit 16 has a torso portion 18, a first arm member 20, a second arm member 22, a first leg member 24 and a second leg member 26. The arm members 20 and 22 can be sewn, heat welded or otherwise attached to the torso portion 18. Similarly, the leg members 24 and 26 can be attached to the bottom of the torso portion 18. It can be seen in FIG. 1 that the arm member 20 extends outwardly from one side of the torso portion 18. It can also be seen that the other arm member 22 extends outwardly from the opposite side of the torso portion 18. Importantly, the coverall suit 16 is formed of a spun high density polyethylene fiber material. This material is otherwise known as TYVEK (TM), a non-woven multi-directional fibrous fabric, high density polyethylene formed by a continuous process from very fine 0.5–10 micrometer fibers. These non-directional fibers (plexifilaments) are first spun and then bonded together by heat and pressure, without binders or fillers. This material offers a balance of physical characteristics that combine some of the properties of paper, film and cloth. The material contains an antioxidant which provides an oxidative life in excess of twenty years. This creates a new form of plastic material with properties different from those of low density polyethylene. It allows air to flow freely between the person 14 and the wet suit 12 without having to perforate the material. Additionally, high density polyethylene retains its structural integrity so as to render it a stronger material than low density polyethylene. This prolongs the life span of the material. Since the properties of the high density polyethylene are similar to normal woven fabrics, including the properties of softness loose flexibility, and a porous structure, the coverall suit 16 adds a comfort value that no previous garment of this type would offer.

The high density polyethylene is a strong barrier between the person 14 and the wet suit 12. The porous nature of the material allows the skin of the person to properly breathe. Additionally, this material acts as an additional insulator when worn inside the wet suit 12. It will maintain the structural integrity throughout many applications and removals of the wet suit 12. The use of this high density polyethylene, combined with the loose fitting nature of the coverall suit 16, creates an entirely new and cost efficient mode for facilitating the application and removal of the wet suit 12, or the application and removal of other aquatic sportswear. The material further enhances the level of hygiene and comfort to the person 14.

In FIG. 1, it can be seen that the coverall suit 16 includes a thumbless mitten 28 which is affixed to an end of the arm 20 opposite the suit 16. Similarly, a boot member 30 is connected to the leg member 24 so as to fit over the foot of the human 14. The application of the mitten 28 and the boot 30 facilitates the ability of the hand of the person 14 to pass through the arms of the wet suit 12. The application of the boot 30 over the foot of the human 14 enhances the ability to pull the legs of the wet suit 12 over the feet. The mitten 28 can be removed or retained if a glove is placed over the mitten. The boot member 30 can be removed or retained if a wet suit booty is to be used.

Figure 2:
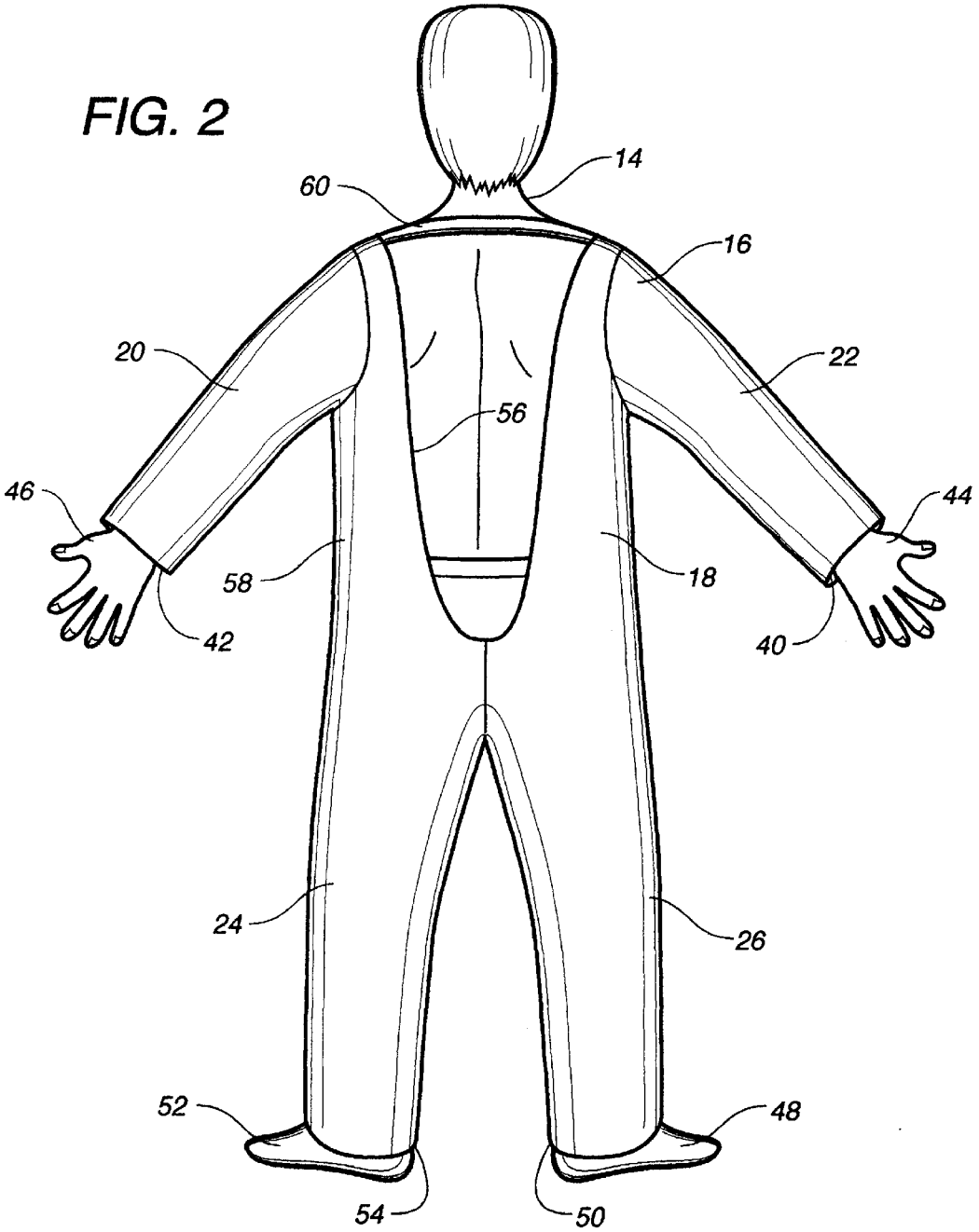
FIG. 2 is a rearward view of the article of the present invention.

Referring to FIG. 2, it can be seen that the coverall suit 16 has been applied to the body of the human 14. Initially, it can be seen that the torso portion 18 has arm member 20 and arm member 22 extending outwardly from opposite sides thereof. The arm member 20 has an opening 42 formed of an end opposite the torso portion 18. The arm member 22 has an opening 40 formed at an end opposite the torso portion 18. It can be seen that the leg members 24 and 26 extend downwardly from the torso portion 18. In the normal application, the hand 44 will extend outwardly of the opening 40 of the arm member 22. The hand 46 will extend outwardly of the opening 42 of the arm member 20. A foot 48 will extend outwardly of the opening 50 at the bottom of the leg member 26. A foot 52 will extend outwardly of the opening 54 at the bottom of the leg member 24.

The torso portion 18 of the coverall suit 16 has a V-shaped opening 56 formed on the back side 58 of the torso portion 18. This V-shaped opening has a narrow portion adjacent the waist of the person 14. The wide end of the V-shaped area 56 opens adjacent to the neck of the person 14. An elastic strap 60 extends across the wide opening of the V-shaped area 56. The elastic strap 60 is affixed to the back portion 58 of the torso portion 18 so as to extend across the open area of the V-shaped area 56. The elastic strap 60 assures that the torso portion 18 will be securely retained on the torso of the person 14. The use of the V-shaped area 56 facilitates entry into the coverall suit 16. The V-shaped area 56 allows the wet suit to be applied thereover without interference with the zipper of the wet suit.

Referring to FIG. 3, it can be seen that the torso portion 18 has a front area 64 which has no openings. A rounded neck area 66 is formed at the top of the torso portion 18 on the front side 64. It can be seen that the arm member 20 has opening 42 at the end opposite the torso portion 18. The arm member 22 has opening 40 at the end opposite the torso portion 18.

Figure 4:
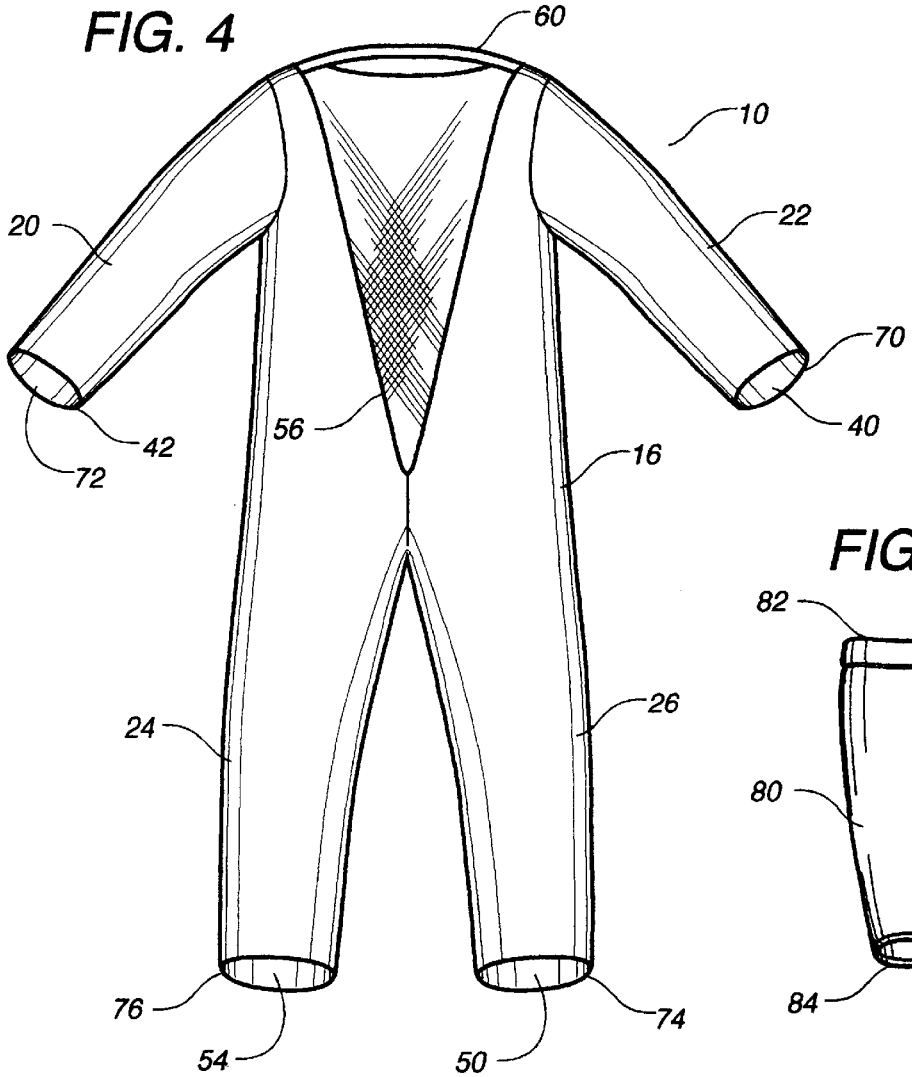
FIG. 4 is an isolated rearward view of the article of the present invention.

FIG. 4 shows the isolated back view of the coverall suit 16 of the present invention. It can be seen that the strap 60 will extend across the V-shaped open area 56. The V-shaped open area 56 allows the user to easily place his or her body on the inside of the suit. The V-shaped open area 56 allows the user to get into the suit from the back. This is much easier than ingressing from the front. It eliminates the struggle of pulling the garment over the shoulders. Also, egressing from the garment is easier since the V-shaped open area 56 eliminates the struggle of wiggling the garment off the shoulders. The configuration of the present invention eliminates the problems inherent in all other one-piece coverall-type garments. The V-shaped open area 56 also keeps the zipper of the wet suit (located in the back of the wet suit) from getting in the coverall suit.

Importantly, it should be noted that the open end 40 of arm 22 can have an elastic band 70 extending therearound. Similarly, the open end 42 of the arm 20 can have an elastic band 72 extending therearound. This will create a snug fit between the open ends 40 and 42 and the respective arms of the user. The open end 50 of the leg member 26 can have an elastic band 74 extending therearound. Similarly, the open end 54 of the leg member 24 can have an elastic band 76 extending therearound.

Figure 5:
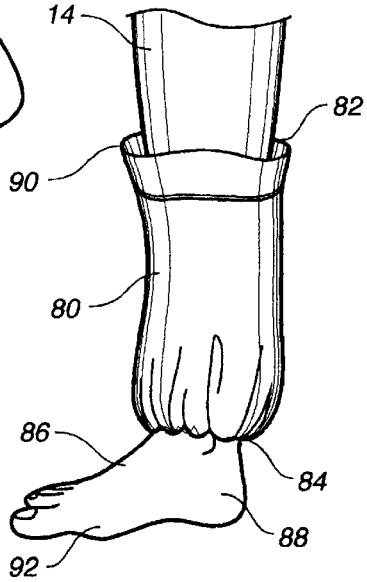
FIG. 5 is a side view showing the footless sock as applied to a human leg.

FIG. 5 shows a footless sock 80 which is formed of the spun high density polyethylene fiber material. This footless sock is a tube member that has an upper opening 82 and a lower opening 84. An elastic band 86 can be formed in the opening 84 so as to assure a snug fit with the ankle 88 of the person 14. If necessary, another elastic band 90 can be formed in the open end 82 of the footless sock 80. The openings 82 and 84 should have a size suitable for allowing the foot 92 to easily pass therethrough. The footless sock 80 is intended to facilitate the passing of the foot 92 through the leg of the wet suit 12.

FIG. 6 is an isolated view of the boot 30 as used in the present invention. The boot 30 has an opening 100 at an upper end therein. The user can simply insert his or her foot through the opening 100 so that the foot resides on the interior of the boot 30. The opening 100 can have an elastic band 102 extending therearound so as to assure a secure fit with the human foot. The boot 30 is formed of the same high density polyethylene fiber material as the coverall suit 16. The boot 30 facilitates the ability to pass the user's foot through the legs of the wet suit 12.

FIG. 7 is an isolated view of the thumbless mitten 28 as is used in the present invention. The thumbless mitten 28 has an opening 110 at one end. The opening 110 can have an elastic band 112 extending therearound. The elastic band 112 assures a secure fit between the opening 110 and the wrist of the user. The mitten 28 is placed around the hands of the person 14 so as to allow the arm of the wet suit 12 to be easily passed thereover.

Figure 8:
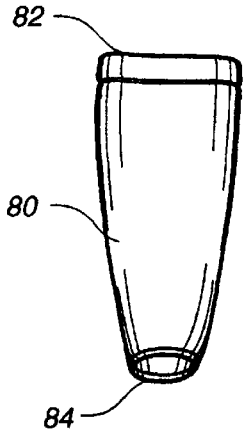
FIG. 8 is an isolated side view of the footless sock of the present invention.

FIG. 8 is an isolated view of the footless sock 80. It can be seen that the footless sock 80 includes the opening 84 at one end and the opening 82 at the other end. Suitable elastic bands can be incorporated around these openings so as to assure a secure fit.

Figure 9:
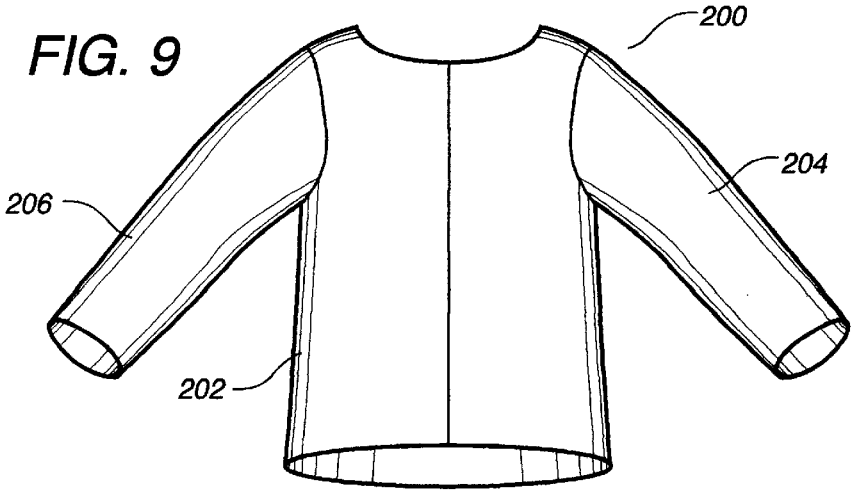
FIG. 9 is a frontal view of an alternative embodiment of the article of the present invention.

FIG. 9 shows an alternative embodiment of the present invention. In this alternative embodiment, the torso portion 202 is isolated from the leg members. Specifically, the torso portion 202 includes arm members 204 and 206. The article 200 is formed of the same material as in the previous embodiments. The article 200 can be used for the application of the torso portion of the wet suit. Similarly, FIG. 10 shows an alternative embodiment of the present invention which shows pants 300 which are formed of the same material as in the previous embodiments of the present invention. The pants 300 include leg members 302 and 304. The pants 300 can be applied when it is only necessary to apply the lower portion of a wet suit.

The article 200 and the pants 300 can be utilized separately from the wet suit as a warm-up suit. Since the article 200 and the pants 300 effectively retain body heat, they can serve as a lightweight and inexpensive sweat suit.

The method of the present invention is unique for the application of the wet suit. Initially, the body suit 16 is placed over the human body 14. When the suit 16 is placed over the human body 14, the hands and feet of the person 14 will extend outwardly of the arms and legs of the suit 16. The mittens 28, the footless socks 80, and the boots 30 can be applied over the hands, calves and feet of the person 14. At this time, the wet suit 12 can then easily slide over the suit 16. When the mittens 28 pass outwardly of the arms of the wet suit, the mittens 24 can be removed so as to expose the hands of the person 14. Similarly, when the legs of the wet suit 12 are passed over the footless socks 80 and the boots 30 of the present invention, the footless sock 80 and the boots 30 can be removed so as to expose the feet and ankles of the person. The mittens 28, the footless sock 80, and the boots 30 can be reapplied when it is desired to remove the wet suit 12.

If the wet suit has booties, then the boots 30 can be retained on the feet. The boots 30 can facilitate the application and removal of the booties of the wet suit.

The present invention provides a loose fitting garment which will provide additional insulation to the user by allowing the body to heat the layer of water trapped between the garment and the wet suit. The present invention provides a comfortable hygienic garment which will not obstruct the breatheability of the skin. The present invention is a reusable garment which facilitates the ability to apply damp or wet aquatic sportswear. It not only facilitates the application of the wet suits, it also makes the application of the cold or uncomfortable wet suit much more tolerable by insulating the immediate skin surface from the cold cellular rubber. The article of the present invention maintains its structural integrity even after several applications. The article 10 is easy to manufacture, easy to use and relatively inexpensive.

The foregoing disclosure and description of the invention is illustrative and explanatory thereof. Various changes in the details of the illustrated construction or in the steps of the described method may be made within the scope of the appended claims without departing from the true spirit of the invention. The present invention should only be limited by the following claims and their legal equivalents.

I claim:

1. A method for facilitating the application of a wet suit comprising the steps of:

forming a non-skintight coverall suit of a spun high density polyethylene fiber material, said coverall suit having a torso portion with a first arm member and a second arm member extending outwardly from opposite sides thereof, said torso portion having a first leg member and a second leg member extending downwardly from said torso portion, said step of forming comprising the steps of:

forming a V-shaped area on a back of said torso portion, said V-shaped area having a wide portion adjacent a top of said coverall suit; and affixing an elastic strap onto said torso portion across said wide portion of said V-shaped area;

placing said coverall suit onto a human body such that human arms extend through said first and second arm members and human legs extend through said first and second leg members;

sliding legs of the wet suit over said first and second leg members of said coverall suit such that human feet extend outwardly of an end of said legs of the wet suit;

sliding arms of the wet suit over said first and second arm members of said coverall suit such that human hands extend outwardly of an end of said arms of the wet suit; and closing the wet suit over said torso portion of said coverall suit.

2. The method of claim 1, further comprising the steps of:

forming a mitten of said spun high density polyethylene fiber material, said mitten having a size suitable for covering a human hand;

placing said mitten over the human hand;

sliding one of the arms of the wet suit over said mitten until said mitten extends outwardly of said one of said arms; and removing said mitten from said human hand.

3. The method of claim 2, further comprising the steps of:

forming another mitten of said spun high density polyethylene fiber material, said another mitten having a size suitable for covering another human hand;

placing said another mitten over another human hand;

sliding another of the arms of the wet suit over said another mitten until said another mitten extends outwardly of the arm of the wet suit; and removing said another mitten from said another human hand.

4. The method of claim 1, further comprising the steps of:

forming a footless sock of said spun high density polyethylene fiber material, said footless sock having a first opening at one end and a second opening at an opposite end, said openings having a diameter suitable for allowing a human foot to pass therethrough;

pulling said footless sock over a human foot such that said footless sock resides around an area adjacent a human ankle and a human calf; and sliding one of said legs of the wet suit over said footless sock until said footless sock extends outwardly of an end of one of the legs of the wet suit.

5. The method of claim 4, further comprising the step of:

removing said footless sock from said area.

6. The method of claim 5, said step of removing comprising:

pulling said footless sock from between said one of the legs of the wet suit and said area such that said footless sock slides over the human foot.

7. The method of claim 1, further comprising the step of:

forming a boot of said spun high density polyethylene fiber material, said boot having a size suitable for covering a human foot;

placing said boot over said human foot;

sliding one of the legs of the wet suit over said boot until said boot extends outwardly of said one of the legs; and removing said boot from said human foot.

8. The method of claim 7, further comprising the steps of:

forming another boot of said spun high density polyethylene fiber material, said another boot having a size suitable for covering another human foot;

placing said another boot over said another human foot;

sliding another of the legs of the wet suit over said another boot until said another boot extends outwardly of the another of the legs; and removing said another boot from said another human foot.

* * * * *